US008167425B2

(12) United States Patent
Nakamaki et al.

(10) Patent No.: US 8,167,425 B2
(45) Date of Patent: May 1, 2012

(54) METHOD OF PRINTING AN INDICATION OF DEFECTIVE PRINTING, AN INKJET PRINTER, A PRINTER DRIVER, AND A DEFECTIVE PRINTING NOTIFICATION METHOD

(75) Inventors: Motohiro Nakamaki, Azumino (JP); Tomohiro Kodama, Matsumoto (JP); Sohei Yagisawa, Chikuma (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 12/407,948

(22) Filed: Mar. 20, 2009

(65) Prior Publication Data

US 2009/0244164 A1 Oct. 1, 2009

(30) Foreign Application Priority Data

Mar. 26, 2008 (JP) ..... 2008-079977
Feb. 16, 2009 (JP) ..... 2009-032348

(51) Int. Cl.
*B41J 2/01* (2006.01)
*B41J 3/00* (2006.01)

(52) U.S. Cl. ..... 347/107; 347/2; 400/103

(58) Field of Classification Search ..... 400/103
See application file for complete search history.

(56) References Cited

U.S. PATENT DOCUMENTS 4,587,411 A * 5/1986 Obstfelder et al. ..... 400/103
5,130,805 A * 7/1992 Rikima ..... 358/296
6,106,094 A 8/2000 Otani et al.
7,192,115 B2 3/2007 Kojima
2004/0057768 A1* 3/2004 Oshino et al. ..... 400/103
2005/0063666 A1 3/2005 Takatsuka
2007/0134969 A1* 6/2007 Endo et al. ..... 439/341
2008/0018691 A1 1/2008 Koase
2008/0074453 A1* 3/2008 Furukawa ..... 347/14

FOREIGN PATENT DOCUMENTS

EP 1431043 A1 6/2004
JP 9-136411 5/1997
JP 2002-272102 9/2002
JP 2003-118133 4/2003
JP 2005-096137 4/2005
JP 2005-119295 5/2005
JP 2006-001162 1/2006
JP 2008-105417 5/2008
WO 0102184 A1 1/2001

* cited by examiner

*Primary Examiner* — Shelby Fidler
(74) *Attorney, Agent, or Firm* — Mark P. Watson

(57) ABSTRACT

A method of printing an indication of defective printing can print a defective printing mark indicating that printing was not completed normally on a printout containing unprinted or missing dots. When printing one page of print data on recording paper is completed but before a paper discharge command indicating a page break (step ST3) is executed, the operation printing the one page of print data is interrupted and whether or not ink droplets are being discharged normally from the ink nozzles of the inkjet head is detected. If the ink droplets are not being discharged normally, the recording paper is conveyed in reverse direction and print data for the defective printing mark is printed on the recording paper as part of the interrupt process. Therefore, if the recording paper contains unprinted (missing) dots, a defective printing mark is printed on the recording paper and printing the one page of print data then ends.

14 Claims, 8 Drawing Sheets

METHOD OF PRINTING AN INDICATION OF DEFECTIVE PRINTING, AN INKJET PRINTER, A PRINTER DRIVER, AND A DEFECTIVE PRINTING NOTIFICATION METHOD

CROSS-REFERENCE TO RELATED APPLICATIONS

Japanese Patent application No. 2008-079977, filed Mar. 26, 2008, and Japanese Patent application No. 2009-032348, filed Feb. 16, 2009, are hereby incorporated by reference in their entirety.

BACKGROUND

1. Field of Invention

The present invention relates to a method of printing an indication of defective printing that prints a defective printing mark indicating that the printer did not print normally on a print medium, e.g. paper, when printing occurs because ink droplets are not discharged normally from the ink nozzles of an inkjet head. The present invention also relates to an inkjet printer and a printer driver, and to a defective printing notification method.

2. Description of Related Art

Serial inkjet printers print by discharging ink droplets from the ink nozzles of an inkjet head so that the ink droplets land at the desired position on recording paper that is conveyed perpendicularly to a main scanning direction while moving the inkjet head mounted on a carriage in the main scanning direction.

Inkjet printers that use a line inkjet head print by conveying recording paper positioned opposite a stationary inkjet head while depositing ink droplets at desired positions on the paper.

If an ink nozzle becomes clogged by, for example, a bubble left in the ink nozzle, or if foreign matter is left on the nozzle surface of the inkjet head, the ink droplets may be deposited at a different position than the desired position, or ink droplets may not be discharged, and a printing defect characterized by unprinted or missing dots occurs.

When printing labels that are applied to medical products used in medical facilities, for example, high quality printing that is free of this missing dot problem is essential to prevent treatment errors caused by reading errors. High quality printing free of missing dots is also required when printing two-dimensional symbols such as QR Code symbols to avoid errors when read by a code reader. To avoid such problems caused by missing dots, Japanese Unexamined Patent Appl. Pub. JP-A-2003-118133 discloses a serial inkjet printer that can detect whether or not ink droplets are discharged normally from each of the ink nozzles and can appropriately execute a nozzle recovery operation. More specifically, this serial inkjet printer detects whether or not ink droplets are discharged correctly from each if the plural ink nozzles before printing such items. If ink droplets are not discharged correctly, the printer executes a nozzle recovery operation such as vacuuming ink and bubbles from each of the ink nozzles, or wiping the nozzle surface of the inkjet head, to restore the nozzles to the normal working condition.

Even if a nozzle recovery process is executed before printing starts, ink droplets may cease being discharged correctly from one or more ink nozzles while printing the print data on the recording paper.

Furthermore, because it can be difficult to identify from the printout whether there are missing dots, printouts having missing dots can be mistakenly read as though they had been printed correctly. When a printout with missing dots is used, the printed content may be read incorrectly depending on the type of printout, and the printed output becomes less reliable.

SUMMARY OF INVENTION

A first aspect of the present invention is a method of printing an indication of defective printing that prints a defective printing mark indicating that the printer did not print normally on the print medium; specifically, when printing occurs while ink droplets are not discharged normally from the ink nozzles of an inkjet head. A second aspect of the present invention is a notification method for indicating that the printer did not print normally on the print medium; specifically, when printing occurs while ink droplets are not discharged normally from the ink nozzles of an inkjet head. Other aspects of the present invention are an inkjet printer and a printer driver.

A first aspect of the invention is a method of printing an indication of defective printing, including: a page printing step of printing one page of print data on a print medium by an inkjet head; and an interrupt process step of executing an interrupt process when printing one page of print data is completed but before a control command indicating a page break in the page printing step is executed, and including a defective ink discharge detection step of detecting whether or not ink droplets are being discharged normally from each ink nozzle of the inkjet head, a reverse transportation step of conveying the print medium a predetermined distance in a reverse direction opposite to the transportation direction in which the print medium is conveyed when printing the one page of print data if ink droplets are not being discharged normally from the ink nozzles, and a defective printing mark printing step of printing previously stored print data for a defective printing mark on the print medium.

Another aspect of the invention is an inkjet printer having a page printing controller that prints one page of print data on a print medium; an interrupt process controller that executes an interrupt process when the page printing controller completes printing one page of print data but before a control command indicating a page break is executed; and a storage memory that store print data for a defective printing mark. The interrupt process controller includes a defective ink discharge detection controller that detects whether or not ink droplets are being discharged normally from each ink nozzle of the inkjet head, a reverse transportation controller that conveys the print medium a predetermined distance in a reverse direction opposite to the transportation direction in which the print medium is conveyed when printing the one page of print data if ink droplets are not being discharged normally from each of the ink nozzles, and a defective printing mark printing controller that prints the print data for a defective printing mark on the print medium if the print medium is conveyed in reverse of the transportation direction.

Another aspect of the invention is a printer driver having a page printing controller that controls driving an inkjet printer to print one page of print data on a print medium; and an interrupt process controller that executes an interrupt process when the inkjet printer completes printing one page of print data but before a control command indicating a page break is executed. The interrupt process controller includes a defective ink discharge detection controller that detects whether or not ink droplets are being discharged normally from each ink nozzle of the inkjet head in the inkjet printer, a reverse transportation controller that controls driving the inkjet printer to convey the print medium a predetermined distance in a reverse direction opposite the transportation direction in which the print medium is conveyed when printing the one page of print data if ink droplets are not being discharged normally from each of the ink nozzles, and a defective printing mark printing controller that controls driving the inkjet printer to print previously stored print data for a defective printing mark on the print medium if the print medium is conveyed in reverse of the transportation direction.

Another aspect of the invention is a method of printing an indication of defective printing including: a printing step of printing print data on a print medium using ink droplets discharged from the ink nozzles of an inkjet head; a defective ink discharge detection step of detecting if ink droplets are being discharged normally from each ink nozzle of the inkjet head after the printing step; and a defective printing mark printing step of conveying the print medium to a position that is printable by the inkjet head, and printing print data for a defective printing mark on the print medium, if the defective ink discharge detection step determines that ink droplets are not discharged normally from an ink nozzle.

An inkjet printer according to another aspect of the invention has an inkjet head having ink nozzles for discharging ink droplets; a head maintenance mechanism for detecting the discharge state of the ink droplets; a transportation mechanism for conveying a print medium that is printed using the ink droplets; a storage memory for storing print data for printing a defective printing mark; and a control unit that controls the inkjet head, head maintenance mechanism, and transportation mechanism. The controller includes an interrupt process controller that executes an interrupt process when a printing controller completes printing a predetermined range of the print data. The interrupt process controller includes a defective ink discharge detection controller that controls the inkjet head and head maintenance mechanism, and detects if ink droplets are being discharged normally from the ink nozzles; a transportation controller that controls the transportation mechanism to convey the print medium to a position that is printable by the inkjet head when ink droplets are not discharged normally from the ink nozzle; and a defective printing mark printing controller that controls the ink jet head to print the print data for a defective printing mark on the print medium by the inkjet head.

A method of printing an indication of defective printing according to another aspect of the invention includes a printing step of printing print data on a print medium using ink droplets discharged from the ink nozzles of an inkjet head; a defective ink discharge detection step of detecting whether or not ink droplets are discharged normally from each ink nozzle of the inkjet head after the printing step; and a defective printing mark printing step of printing print data for a defective printing mark at the portion of the print medium that was printed when the defective ink discharge detection step detects that ink droplets are not being discharged normally from an ink nozzle.

Another aspect of the invention is a printer having an inkjet head having ink nozzles for discharging ink droplets, a head maintenance mechanism for detecting the discharge state of the ink droplets, a transportation mechanism for conveying a print medium that is printed using the ink droplets, a storage for storing print data for printing a defective printing mark, and a control unit that controls the inkjet head, head maintenance mechanism, and transportation mechanism. The control unit includes a printing controller that controls the ink jet head to print the print data on a print medium and an interrupt process controller that executes an interrupt process when the printing controller completes printing a predetermined range of the print data. The interrupt process controller includes a defective ink discharge detection controller that controls the inkjet head and head maintenance mechanism, and detects if ink droplets are being discharged normally from the ink nozzles, and a defective printing mark printing controller that controls the inkjet head to print the print data for a defective printing mark on the print medium when ink droplets are not discharged normally from the ink nozzle.

A defective printing notification method according to another aspect of the invention includes a printing step of printing print data on a print medium using ink droplets discharged from the ink nozzles of an inkjet head; a defective ink discharge detection step of detecting whether or not ink droplets are discharged normally from each ink nozzle of the inkjet head after the printing step; and reporting with a notification device when the defective ink discharge detection step detects that ink droplets are not being discharged normally from each ink nozzle.

An ink jet printer according to another aspect of the invention includes an inkjet head having ink nozzles for discharging ink droplets, a head maintenance mechanism for detecting the discharge state of the ink droplets, a transportation mechanism for conveying a print medium, a notification device for reporting the discharge state of ink droplet and a control unit that controls the inkjet head, head maintenance mechanism, transportation mechanism, and notification device. The control unit includes a printing controller that controls the inkjet head to print print data on a print medium and an interrupt process controller that executes an interrupt process when the printing controller completes printing a predetermined range of the print data. The interrupt process controller includes a defective ink discharge detection controller that controls the inkjet head and head maintenance mechanism, and detects if ink droplets are being discharged normally from the ink nozzles and a notification controller that controls the notification device to report the discharge state of ink droplet, when ink droplets are not discharged normally from the ink nozzle.

When there may be unprinted or missing dots on the printed print medium, the method of printing an indication of defective printing, the inkjet printer, and the printer driver according to the present invention print a defective printing mark indicating that the printout is invalid or defective on the printed print medium. The user can therefore know by simply seeing the defective printing mark on the printed print medium that there may be unprinted or missing dots in the printout, and can thus easily and reliably determine the print quality of the printed print medium.

A defective printing notification method and ink jet printer according to another aspect of the invention reports that printing is invalid when there may be unprinted or missing dots on the printed print medium. The user can thus know by way of an audible buzzer, for example, that there may be unprinted or missing dots in the printout, and can thus easily and reliably determine the print quality of the printed print medium.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A first embodiment of the present invention is described below with reference to the accompanying figures.

Roll Paper Printer

Figure 1A:
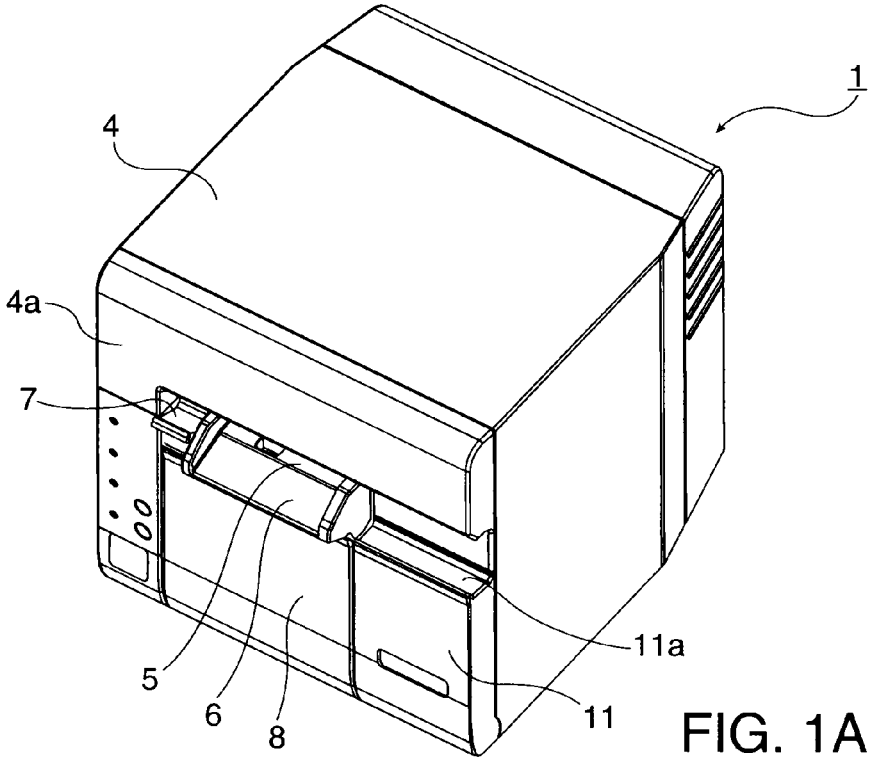
FIGS. 1A and 1B are perspective views of a roll paper printer according to the present invention.
Figure 1B:
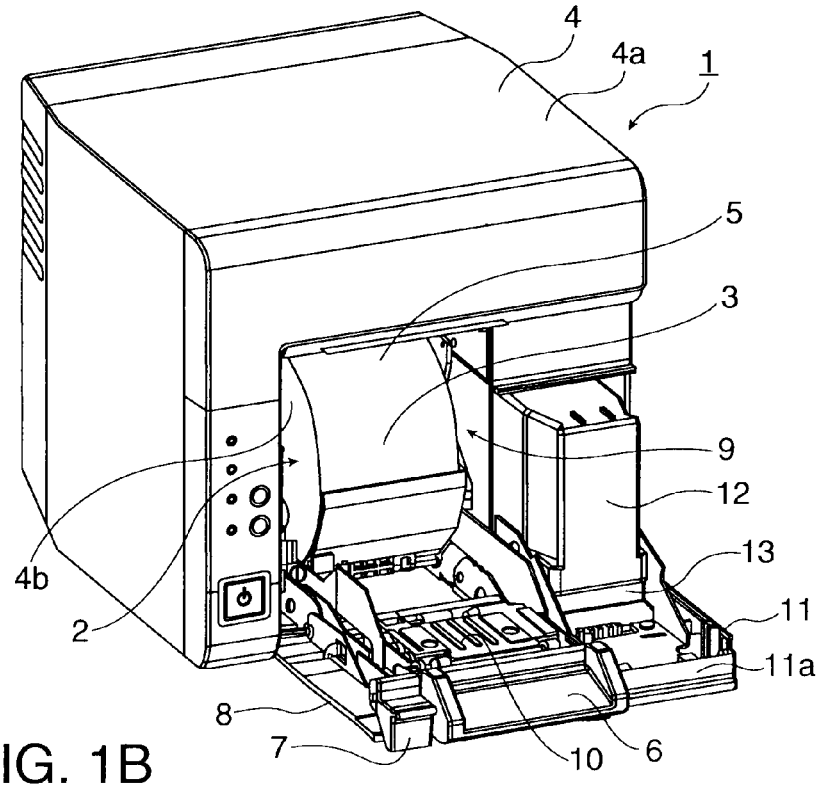

FIG. 1 is a perspective view of a roll paper printer according to the present invention, FIG. 1A showing the printer with the roll paper cover and the ink cartridge cover closed, and FIG. 1B showing the printer with the roll paper cover and ink cartridge cover open.

The roll paper printer 1 according to this embodiment of the invention is an inkjet printer that prints on a web of recording paper 3 delivered from roll paper 2. The roll paper printer 1 has a substantially square, box-like printer housing 4 with a recording paper exit 5 of a predetermined width formed in the front of the outside case 4*a* of the printer housing 4. An exit guide 6 protrudes downward from the bottom side of the paper exit 5. A cover opening lever 7 is positioned beside the exit guide 6. A rectangular opening 4*b* for loading and removing the roll paper 2 is formed in the outside case 4*a* below the exit guide 6 and cover opening lever 7. This opening 4*b* is closed by a roll paper cover 8.

Operating the cover opening lever 7 releases the lock so that the roll paper cover 8 can open. When the roll paper cover 8 opens, the roll paper compartment 9 formed inside the printer housing 4 opens as shown in FIG. 1B. At the same time the platen 10, which determines the printing position, moves to the outside of the printer housing 4 together with the roll paper cover 8, and the recording paper 3 transportation path becomes open from the roll paper compartment 9 to the paper exit 5. This enables easily replacing the roll paper 2 from the front of the printer housing 4.

An ink cartridge cover 11 is positioned beside the roll paper cover 8. The ink cartridge cover 11 pivots at the bottom and opens forward to a substantially horizontal position when the top end part 1la of the ink cartridge cover 11 is pulled forward. When the ink cartridge cover 11 opens, an ink cartridge holder 13 for holding an ink cartridge 12 storing liquid ink is also pulled forward as shown in FIG. 1B so that the ink cartridge 12 can be easily installed or removed.

Figure 2:
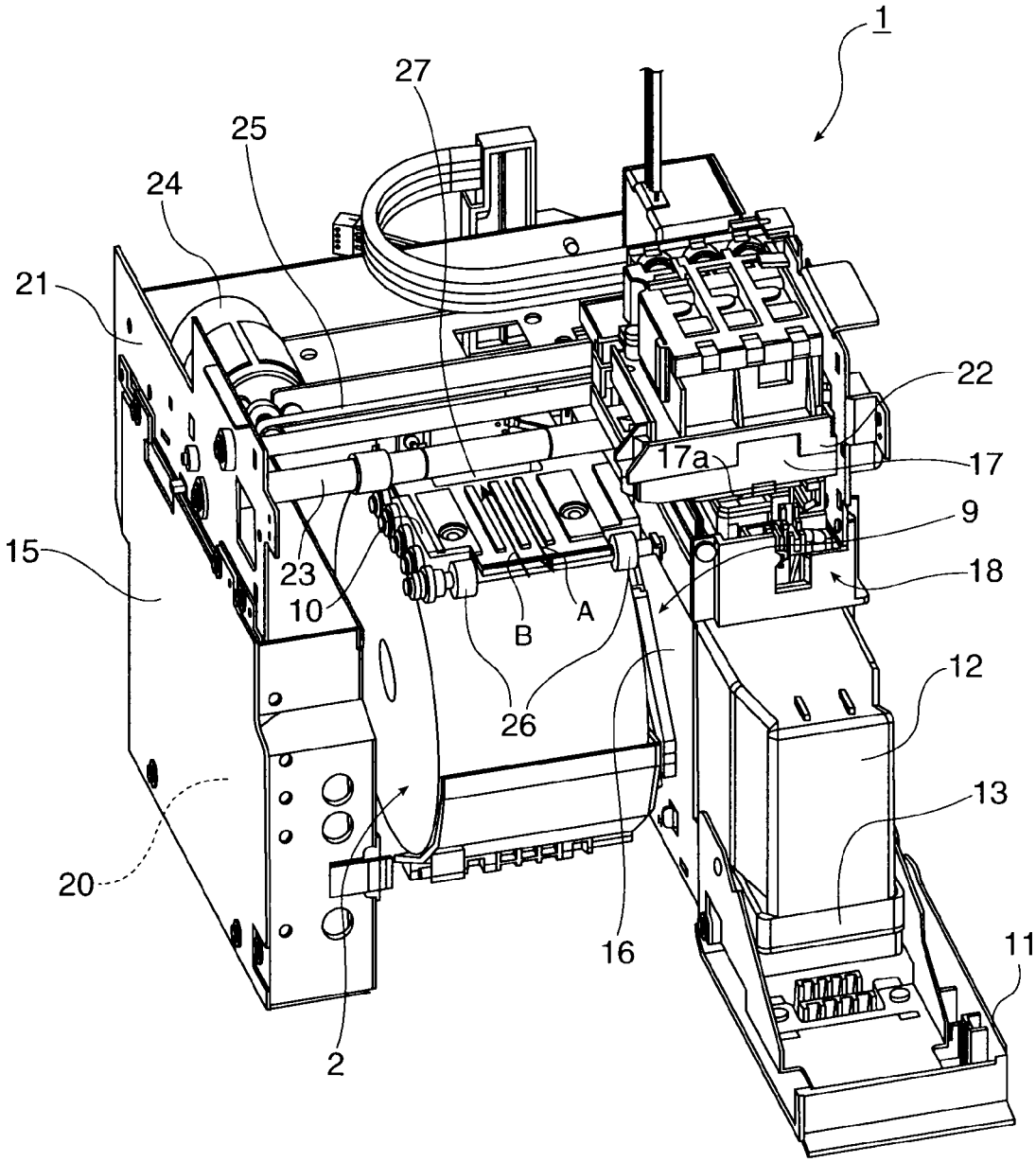
FIG. 2 is a perspective view showing the mechanisms inside the roll paper printer.

FIG. 2 is a perspective view showing the mechanisms inside the roll paper printer 1. FIG. 2 shows the roll paper printer 1 with the outside case 4*a* and roll paper cover 8 removed from the printer housing 4. The roll paper compartment 9 is formed inside the roll paper printer 1 in the middle in the widthwise direction between the sides of the printer frame 15. The roll paper 2 is placed standing up with the core of the roll aligned with the width of the printer in the roll paper compartment 9.

An ink cartridge storage unit 16 for storing the ink cartridge 12 loaded in the ink cartridge holder 13 is formed at a position on the right side of the roll paper compartment 9. A head maintenance mechanism 18 for maintaining the inkjet head 17 is positioned above the ink cartridge storage unit 16.

The head maintenance mechanism 18 executes a defective ink discharge detection process and a nozzle recovery process. The defective ink discharge detection process detects if ink droplets are discharged correctly from each ink nozzle of the inkjet head 17. If ink droplets are not discharged correctly from one or more ink nozzles, the nozzle recovery process is executed to restore the ink nozzles to a normal ink droplet discharge state. Note that the head maintenance mechanism 18 is described in detail below.

A control unit 20 that controls driving the roll paper printer 1 is positioned on the right side of the roll paper compartment 9.

A head unit frame 21 is positioned horizontally to the top end of the printer frame 15 above the roll paper compartment 9 and head maintenance mechanism 18. The inkjet head 17, a carriage 22 that carries the inkjet head 17, and a carriage guide shaft 23 that guides movement of the carriage 22 widthwise to the printer are positioned near the head unit frame 21. A carriage transportation mechanism including a carriage motor 24 and timing belt 25 for moving the carriage 22 bi-directionally along the carriage guide shaft 23 are also positioned nearby.

FIG. 2 shows the inkjet head 17 when it has been moved to the standby position at the right end of the carriage guide shaft 23. The standby position is directly above the head maintenance mechanism 18.

The inkjet head 17 has a nozzle surface 17*a* in which a plurality of ink nozzles are formed, and the inkjet head is mounted on the carriage 22 with the nozzle surface 17*a* facing down. The platen 10 is positioned extending substantially parallel to the printer width (the direction of carriage movement) above the roll paper compartment 9 at a position opposite the nozzle surface 17*a* with a predetermined gap therebetween.

Front paper transportation rollers 26 are positioned in front of the platen 10 (on the downstream side in the paper transportation direction). A rear paper transportation roller 27 extends horizontally widthwise to the printer at a position behind the platen 10 (on the upstream side in the paper transportation direction). Pressure rollers (not shown) are pressed from above with a predetermined amount of pressure against the front paper transportation rollers 26 and rear paper transportation roller 27. Drive power from a paper transportation motor 28 (see FIG. 5) mounted on the printer frame 15 is transferred to the front paper transportation rollers 26 and rear paper transportation roller 27.

The paper transportation motor 28 is a stepping motor that can turn both forward and reverse. When the paper transportation motor 28 is driven forward, the recording paper 3 is pulled from the roll paper 2 and conveyed from the roll paper compartment 9 to the paper exit 5 in the transportation direction A past the printing position. If the paper transportation motor 28 is driven in reverse, the recording paper 3 that is pulled out past the printing position is conveyed in the reverse direction B, which is opposite to the transportation direction A.

Head Maintenance Mechanism

Figure 3:
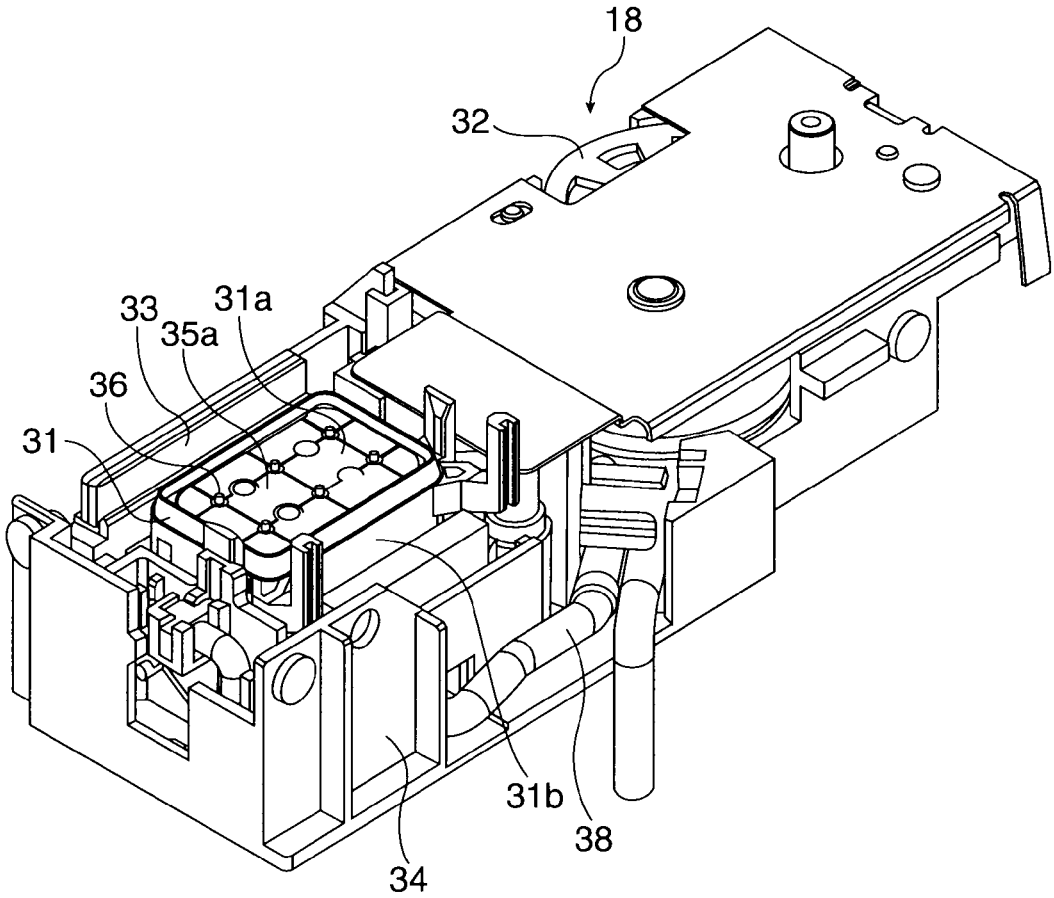
FIG. 3 is a perspective view of the head maintenance mechanism.
Figure 4:
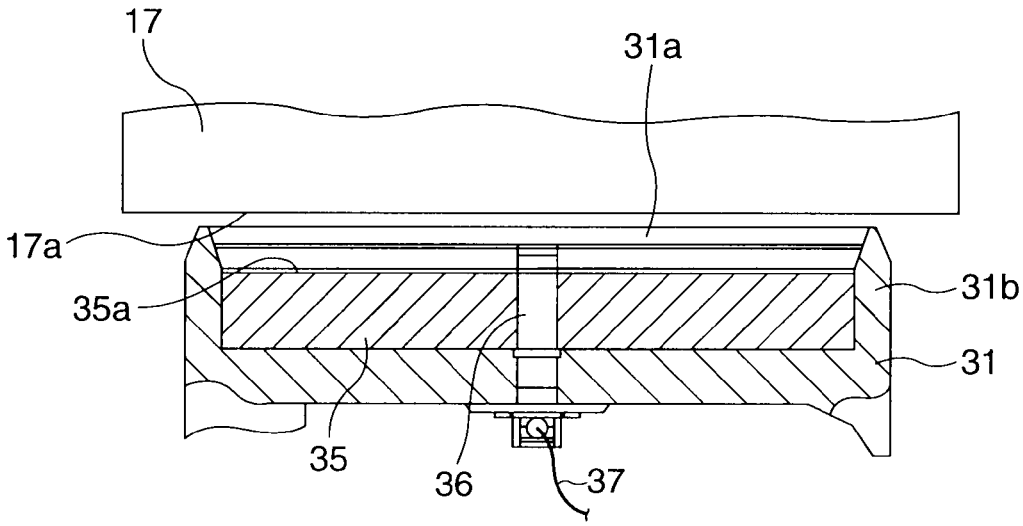
FIG. 4 is a partial sectional view showing the nozzle surface and head cap in direct opposition.

The head maintenance mechanism 18 is described next with reference to FIG. 3 and FIG. 4. FIG. 3 is a perspective view of the head maintenance mechanism 18, and FIG. 4 is a partial section view showing the nozzle surface 17*a* of the inkjet head 17 opposite the head cap of the head maintenance mechanism 18.

The head maintenance mechanism 18 has a head cap 31, an ink suction unit 32, a wiper 33, and a housing 34 enclosing these other parts. The head cap 31 is for capping and sealing the nozzle surface 17*a* in which the nozzles of the inkjet head 17 are formed. The ink suction unit 32 is for vacuuming ink from the ink nozzles of the inkjet head 17. The wiper 33 is for wiping ink and foreign matter from the nozzle surface 17*a*.

The housing 34 is positioned with its long side aligned with the front-back direction of the printer housing 4, and the head cap 31 and wiper 33 are positioned at the front part of the housing 34. The ink suction unit 32 is positioned at the back part of the housing 34. The housing 34 is positioned on the printer frame 15 so that the head cap 31 is opposite the nozzle surface 17*a* when the inkjet head 17 is in the standby position.

The head cap 31 is box-shaped with a top opening 31*a* that can cover the nozzle area of the nozzle surface 17*a* of the inkjet head 17, and is made of rubber or other elastic material. The head cap 31 is formed so that it can move up and down, and when the head cap 31 is moved up proximally to the inkjet head 17 in the standby position, the rim part 31*b* around the top opening 31*a* is pressed tightly to the nozzle surface 17*a* so that it covers the nozzle area.

As shown in FIG. 4, an absorbent member 35 and a conductive member 36 are positioned in the cavity inside the head cap 31. The absorbent member 35 absorbs ink droplets discharged from the ink nozzles, and its top surface 35*a* is positioned recessed below the top opening 31*a*. The conductive member 36 is positioned in the head cap 31 so that the conductive member 36 is electrically connected to the absorbent member 35, and a wire lead 37 is connected to the bottom end part of the conductive member 36.

When detecting if ink droplets are discharged normally from the ink nozzles of the inkjet head 17 as part of the defective ink discharge detection process, the control unit 20 raises the head cap 31 to a position forming a narrow gap between the nozzle surface 17*a* of the inkjet head 17 and the top surface 35*a* of the absorbent member 35. Voltage is also applied with a predetermined potential difference between the inkjet head 17 and head cap 31. Charged ink is then sequentially discharged from each ink nozzle of the inkjet head 17, and a signal denoting the current change produced by the charged ink landing on the absorbent member 35 is output through the wire lead 37, thereby enabling detecting from this current change whether or not ink droplets are correctly discharged from each ink nozzle.

A suction tube 38 extending from the ink suction unit 32 is also connected to the inside of the head cap 31 as shown in FIG. 3. Note that the ink suction unit 32 is a tube pump, one end of the suction tube 38 is connected to the head cap 31, and the other end is connected to a connection unit (not shown in the figure) that guides ink to a waste ink introduction unit of the ink cartridge 12 that is held in the ink cartridge storage unit 16.

When ink is vacuumed from the ink nozzles of the inkjet head 17 as part of the nozzle recovery process, the control unit 20 raises the head cap 31 so that the rim part 31*b* is tight to the nozzle surface 17*a*. The control unit 20 also operates the tube pump, creating negative pressure in the cavity inside the head cap 31 whereby ink is drawn from the ink nozzles and discharged into the absorbent member 35. Any bubbles inside the ink nozzles are expelled at the same time.

The wiper 33 is for wiping ink and foreign matter from the nozzle surface 17*a*, and is a flat blade made of rubber or other elastic material. The wiper 33 can move up and down so that the wiper 33 can move into contact with the print head and separate from the print head.

When the nozzle surface 17*a* is wiped with the wiper 33 as part of the nozzle recovery process, the control unit 20 retracts the nozzle surface 17*a* of the inkjet head 17 from directly above the wiper 33 and then raises the wiper 33 so that the distal end of the wiper 33 protrudes slightly above the height (elevation) of the nozzle surface 17*a*. The control unit 20 then causes the inkjet head 17 to move along the carriage guide shaft 23 so that the inkjet head 17 passes over the wiper 33. This causes the distal end of the wiper 33 to rub against the nozzle surface 17*a* so that foreign matter and ink on the nozzle surface 17*a* is wiped off by the distal end of the wiper 33.

Note that if the inkjet head 17 is stopped in the standby position for a predetermined time or longer, the control unit 20 raises the head cap 31 so that the rim part 31*b* is sealed against the nozzle surface 17*a*. This protects the nozzle area of the inkjet head 17 from drying and dust, for example.

Control System

Figure 5:
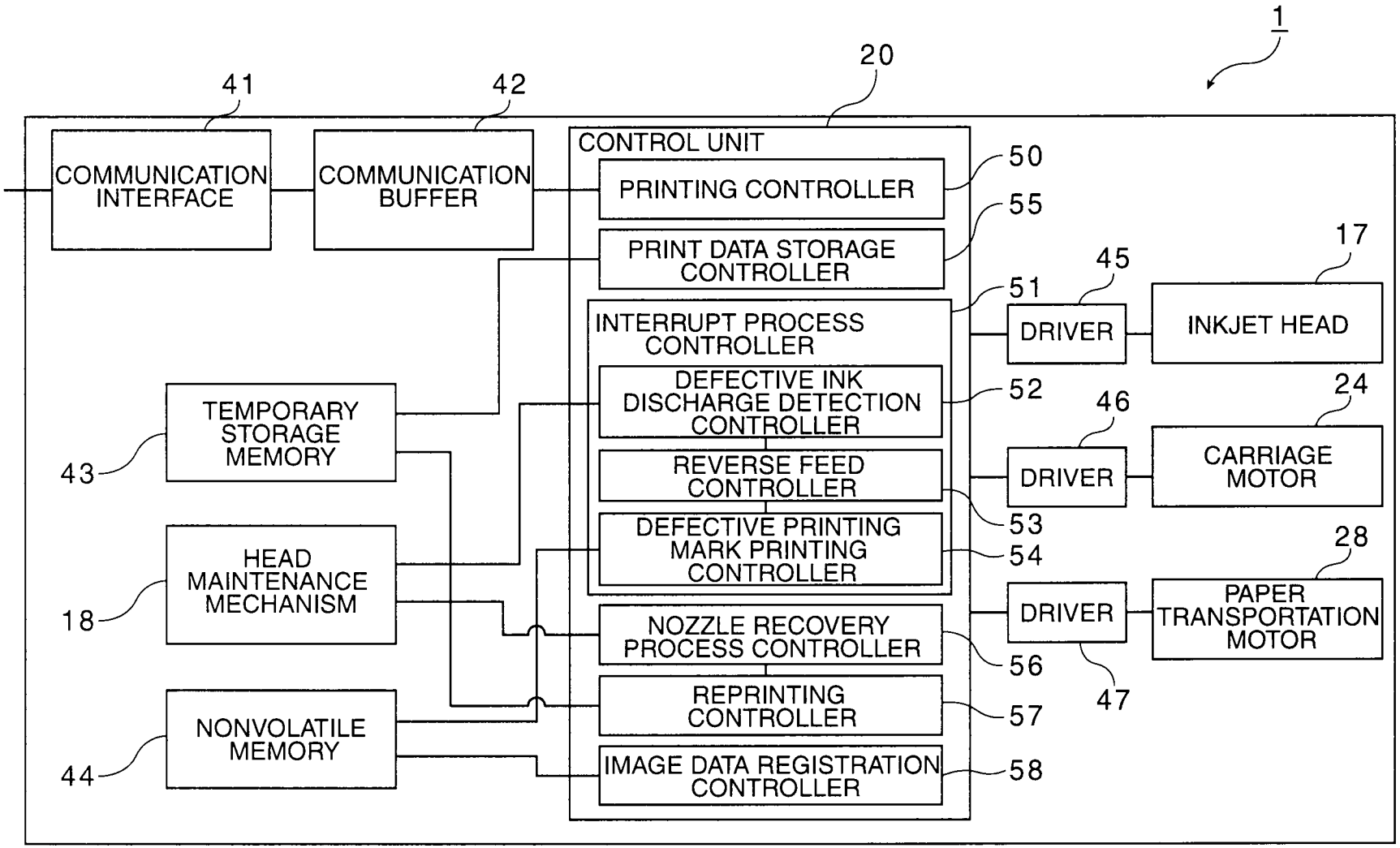
FIG. 5 is a schematic block diagram showing the control system of a roll paper printer according to a first embodiment of the invention.

FIG. 5 is a schematic block diagram showing the control system of the roll paper printer 1. The control system is built around a control unit 20 including a CPU, ROM, and RAM. Print data from a host device such as a host computer is input to the control unit 20 through a communication interface 41 and communication buffer 42. Temporary storage memory 43, nonvolatile memory (nonvolatile storage) 44, and the head maintenance mechanism 18 are connected to the control unit 20, and the current change signal extracted from the conductive member 36 is input from the head maintenance mechanism 18. The inkjet head 17 is connected through a head driver 45 to the output side of the control unit 20. The carriage motor 24 and paper transportation motor 28 are also connected through motor drivers 46 and 47, respectively.

The control unit 20 has a printing controller 50 and an interrupt process controller 51. The printing controller 50 (page printing controller) controls driving the inkjet head 17, carriage motor 24, and paper transportation motor 28 to print the print data. The interrupt process controller 51 executes an interrupt process. This process occurs after printing the print data for one page by the printing controller 50 is completed but before a control command denoting the page break is executed.

The interrupt process controller 51 includes a defective ink discharge detection controller 52, a reverse feed controller 53, and a defective printing mark printing controller 54.

The control unit 20 also has a print data storage controller 55, nozzle recovery process controller 56, reprinting controller 57, and image data registration controller 58.

Included in the print data from the host device (host) is the print data to be printed on the recording paper, and a paper discharge command. The paper discharge command is a control command indicating a break between pages, and causes the recording paper 3 to be conveyed a predetermined distance in transportation direction A and discharged from the paper exit 5. This predetermined distance in this embodiment of the invention is the distance from where printing ends on one page and where printing starts on the next page.

Note that because this embodiment of the invention uses roll paper, a paper cut command may be inserted after the paper discharge command to sever the printed portion of the recording paper 3 from the roll. The roll paper may alternatively be discharged as a continuous, uncut length of paper. If the roll paper is label paper having a plurality of labels affixed at equal intervals on the surface of a lining, the printed paper is commonly discharged without being cut. If such label paper is used, printing is typically controlled so that each label constitutes one page.

When printing the print data for one page on the print medium is completed but just before the paper discharge command is executed, or more specifically when printing all print data in the one-page range is completed, the defective ink discharge detection controller 52 interrupts the printing controller 50 operation of printing the print data for the one page and detects whether or not the ink droplets are still discharged normally from each of the ink nozzles. More specifically, the defective ink discharge detection controller 52 controls driving the carriage motor 24 to move the inkjet head 17 to the standby position, and then controls driving the inkjet head 17 and head maintenance mechanism 18 to detect whether or not ink droplets are discharged normally from each of the ink nozzles based on the current change signal extracted from the conductive member 36.

If the ink droplets are being discharged normally from the ink nozzles, the defective ink discharge detection controller 52 returns drive control of the roll paper printer 1 to the printing controller 50 to continue executing the print job that was interrupted. When drive control of the roll paper printer 1 is returned from the defective ink discharge detection controller 52 to the printing controller 50, the printing controller 50 executes the paper discharge command and the recording paper 3 is discharged from the paper exit 5. If there is any print data for a next page, the printing controller 50 then proceeds to print the next print data.

If the defective ink discharge detection controller 52 determines that ink droplets are not discharged normally from an ink nozzle, control of the pending interrupt process is passed to the reverse feed controller 53 which drives the paper transportation motor 28 a predetermined number of steps in reverse to convey the recording paper 3 a predetermined distance in the reverse direction B, which is opposite transportation direction A. This predetermined distance is the distance required to position the ink nozzles of the inkjet head to the printable area of the recording paper. The distance the recording paper 3 is conveyed in the reverse direction B in this embodiment of the invention is, for example, 1 inch, which is the width of the inkjet head 17 in the paper transportation direction A (that is, the length of the nozzle array of the inkjet head).

The paper is conveyed in reverse so that the defective printing mark can be printed at a position in the printing area even if the last printed line is at the end of the page, thereby assuring that the defective printing mark is easily recognized by the user.

When the recording paper 3 has been conveyed the predetermined distance in the reverse direction B, control of the pending interrupt process is passed to the defective printing mark printing controller 54 to print the print data for the defective printing mark, which is stored in advance in nonvolatile memory 44, on the recording paper 3. The print data for the defective printing mark that is stored in the nonvolatile memory 44 is image data for a long, narrow image that can be printed on the recording paper 3 in a single pass of the inkjet head 17 in the main scanning direction. For example, because the inkjet head can print a band one inch high in this embodiment of the invention, the image data is for an image that is less than one inch high and is shorter than the width of the recording paper 3.

When the print data for the defective printing mark has been printed on the recording paper 3, the defective printing mark printing controller 54 returns drive control of the roll paper printer 1 to the printing controller 50, which continues the operation of printing the print data, which was interrupted. More specifically, when drive control of the roll paper printer 1 returns from the defective printing mark printing controller 54 to the printing controller 50, the printing controller 50 executes the paper discharge command and the recording paper 3 is thus discharged from the paper exit 5. If there is any print data for a next page, the printing controller 50 then proceeds to print the next print data.

When the printing controller 50 begins printing one page of print data, the print data storage controller 55 buffers that one page of print data to the temporary storage memory 43.

If ink droplets are not discharged correctly from an ink nozzle and the printing controller 50 finishes printing the one page of print data, or, more specifically, printing is completed up to the point of executing the paper discharge command, the nozzle recovery process controller 56 executes the nozzle recovery process to restore the ink droplet discharge state of each ink nozzle to normal operating condition. More specifically, when recording paper 3 on which the defective printing mark was printed is discharged from the paper exit 5, the nozzle recovery process controller 56 controls driving the head maintenance mechanism 18 to vacuum ink from the ink nozzles. The carriage motor 24 and head maintenance mechanism 18 are also controlled to wipe the nozzle surface 17*a* of the inkjet head 17 with the wiper 33.

When the nozzle recovery process is completed, the reprinting controller 57 delivers a new printing portion of the recording paper 3 from the roll paper 2 and reprints the one page using the print data that was buffered in the temporary storage memory 43.

The image data registration controller 58 enables the user to store the desired image data in the nonvolatile memory 44 as the print data for the defective printing mark. When the control command and image data in the specified format for registering the print data for a defective printing mark is received from the host, the image data is stored in nonvolatile memory 44.

Printing the Defective Printing Mark

Figure 6:
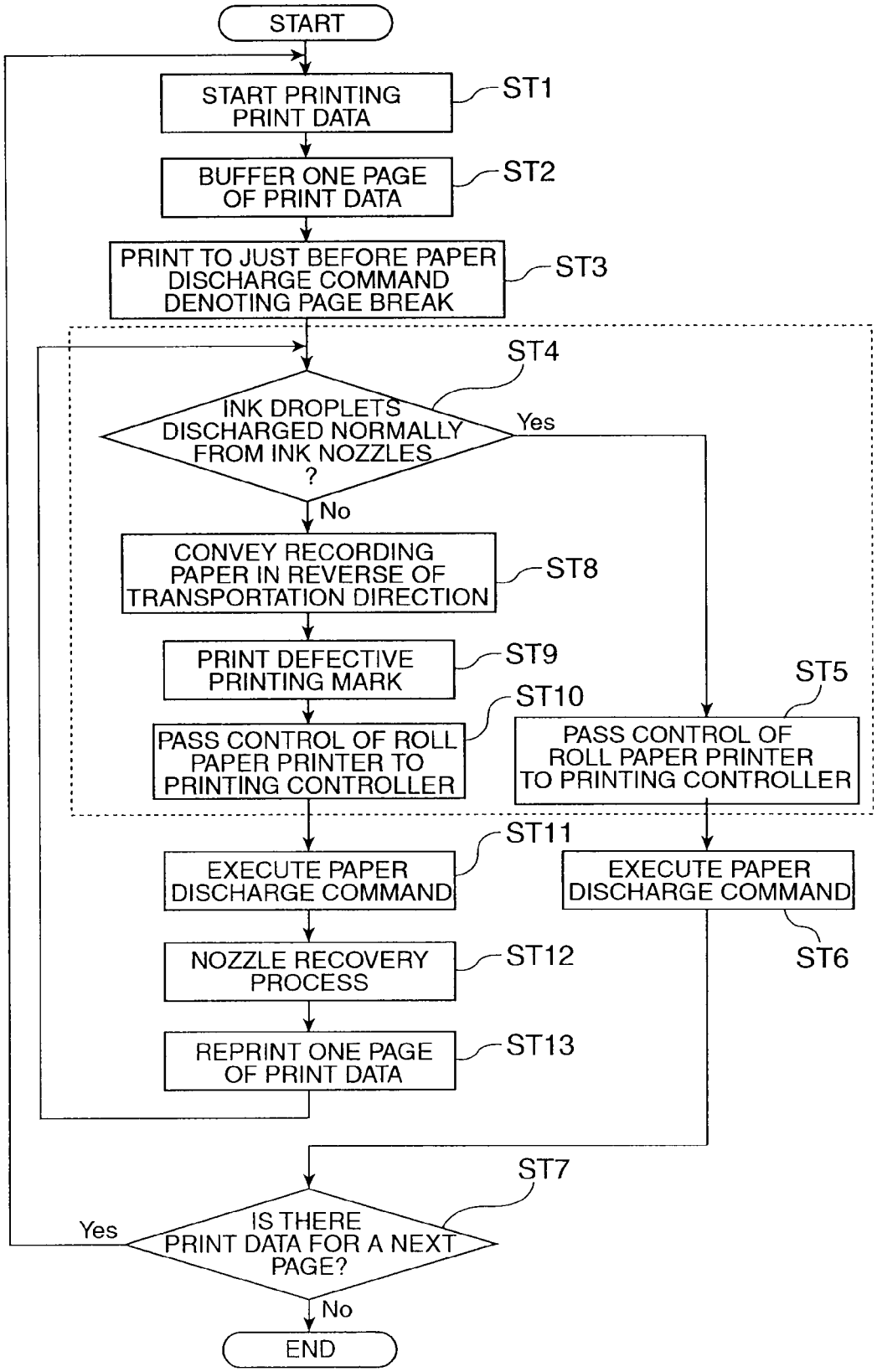
FIG. 6 is a flow chart illustrating the operation for printing an indication of defective printing.
Figure 7A:
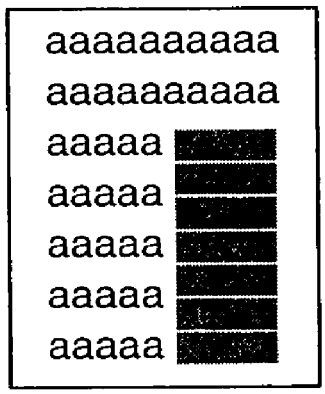
FIGS. 7A and 7B show sample printouts for one page of print data.
Figure 7B:
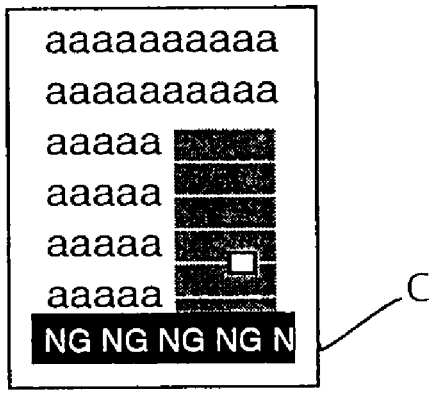

The process of printing a defective printing mark is described next with reference to FIG. 6 and FIG. 7. FIG. 6 is a flow chart of the process for printing a defective printing mark. The dotted line in FIG. 6 denotes the steps of the interrupt process executed by the interrupt process controller 51. FIG. 7 shows sample printouts of the print data for one page. FIG. 7A shows the printout when ink droplets are discharged normally from each of the ink nozzles while printing one page of print data. FIG. 7B shows the printout when ink droplets are not discharged normally from an ink nozzle while printing one page of print data and the defective printing mark is then printed on the recording paper 3.

When the roll paper printer 1 receives print data from the host device, the printing controller 50 starts printing the one page of print data (step ST1). The print data storage controller 55 also temporarily stores the one page of print data for which printing started in the temporary storage memory 43 (step ST2).

When the printing controller 50 finishes printing the one page of print data to a time just before the paper discharge command denoting the page break is executed (step ST3), the defective ink discharge detection controller 52 interrupts printing the one page of print data by the printing controller 50 and detects if the ink droplets are being discharged normally from the ink nozzles (step ST4).

If ink droplets are discharged normally from the ink nozzles in step ST4 (step ST4 returns Yes), the defective ink discharge detection controller 52 returns drive control of the roll paper printer 1 to the printing controller 50 (step ST5). More specifically, because the interrupt process ends in step ST5, the printing controller 50 executes the paper discharge command, which is a control command indicating a page break, and printing the one page of print data ends (step ST6).

As a result, recording paper 3 printed with the one page of print data is discharged from the paper exit 5. A sample of the recording paper 3 discharged in step ST6 is shown in FIG. 7A.

If the print data received from the host contains print data for a next page that has not been printed (step ST7 returns Yes), control returns to step ST1. More specifically, the printing controller 50 continues printing the remaining print data. If there is no print data for another page (step ST7 returns No), the printing controller 50 stops printing the print data.

If the ink droplets are not discharged normally from the ink nozzles in step ST4 (step ST4 returns No), the reverse feed controller 53 conveys the recording paper 3 the predetermined distance (one inch, for example, in this embodiment of the invention) in the reverse direction B as part of the interrupt process interrupting the printing controller 50 from printing the one page of print data (step ST8). The defective printing mark printing controller 54 then prints the image data buffered in the nonvolatile memory 44 as the print data to indicate defective printing (step ST9).

When printing the print data for the defective printing mark is completed, the defective printing mark printing controller 54 returns drive control of the roll paper printer 1 to the printing controller 50 (step ST10). More specifically, because the interrupt process ends in step ST10, the printing controller 50 executes the paper discharge command which is the control command denoting the page break, and printing the one page of print data ends (step ST11).

As a result, recording paper 3 printed with one page of print data and the defective printing mark is discharged from the paper exit 5. An example of the recording paper 3 discharged in step ST11 is shown in FIG. 7B. A block image C containing a pattern of the letters "NG" is printed in a line at the bottom end of the printed area of the recording paper 3 in this example.

The nozzle recovery process controller 56 then controls driving the head maintenance mechanism 18 to execute the nozzle recovery process to restore the ink droplet discharge state of the ink nozzles to the normal condition (step ST12). When the nozzle recovery process ends, the reprinting controller 57 delivers a new printing portion of the recording paper 3 from the roll paper 2 and prints the one page of print data that was buffered in the temporary storage memory 43 (step ST13).

When the one page of print data is reprinted in step ST13, the operation of steps ST4 to ST6, or steps ST4, and ST8 to ST13, repeat as described above.

More specifically, when the reprinting controller 57 finishes printing the one page of print data to a time just before the paper discharge command denoting the page break is executed (step ST3), the defective ink discharge detection controller 52 interrupts printing the one page of print data by the reprinting controller 57 and detects if the ink droplets are being discharged normally from the ink nozzles (step ST4).

If ink droplets are discharged normally from the ink nozzles in step ST4 (step ST4 returns Yes), drive control of the roll paper printer 1 returns from the defective ink discharge detection controller 52 to the reprinting controller 57 (rather than the printing controller 50) (step ST5), and the recording paper 3 printed with one page of print data is discharged from the paper exit 5 (step ST6). This completes printing the one page of print data by the reprinting controller 57.

Control then goes to step ST7, and if the print data received from the host contains print data for a next page that has not been printed (step ST7 returns Yes), control returns to step ST1 and the printing controller 50 continues printing the print data. If there is no print data for another page (step ST7 returns No), the printing controller 50 stops printing the print data.

If the ink droplets are not discharged normally from the ink nozzles in step ST4 (step ST4 returns No), the recording paper 3 is conveyed in reverse and the defective printing mark is printed, drive control of the roll paper printer 1 is returned from the defective printing mark printing controller 54 to the reprinting controller 57 (step ST8 to step ST10), and the recording paper 3 printed with the one page of print data and the defective printing mark is discharged from the paper exit 5 (step ST11). Printing the one page of print data by the reprinting controller 57 thus ends.

The nozzle recovery process is then executed (step ST12), and the reprinting controller 57 then again prints the one page of print data (step ST13).

Effect of this Embodiment of the Invention

When printing one page of print data on the recording paper 3 is completed to a time just before the execution of the paper discharge command, which is a control command indicating a page break, the process of printing one page of print data by the printing controller 50 is interrupted and the defective ink discharge detection controller 52 determines whether or not ink droplets are discharged normally from the ink nozzles of the inkjet head 17. If any of the ink droplets are not discharged normally, an interrupt process is executed so that the reverse feed controller 53 conveys the recording paper 3 in the reverse direction B and the defective printing mark printing controller 54 prints a defective printing mark on the recording paper 3.

More specifically, when there may be one or more missing dots on the recording paper 3 on which the print data was printed, a defective printing mark indicating that the printout is invalid or defective is printed on the recording paper 3. The user can therefore easily tell by looking at the printed recording paper 3 if the recording paper 3 has any missing or unprinted dots, and print quality can be assured with high precision.

Furthermore, because the print data for the defective printing mark is image data for an image C printed in a band, the user can easily know if the printed recording paper 3 is invalid or defective and should be discarded. In addition, because the image can be printed with a single pass of the inkjet head 17 in the main scanning direction, the print data for the defective printing mark can be printed in a short time.

If it is detected that ink droplets are not discharged normally from the ink nozzles of the inkjet head 17, the nozzle recovery process controller 56 in this embodiment of the invention executes a nozzle recovery process to restore the ink droplet discharge state of each ink nozzle to the normal operating condition after printing the one page of print data ends, and the reprinting controller 57 then prints the same one page of print data on new recording paper 3. As a result, the one page of print data that was formed invalid or deficient is printed again. Furthermore, because the ink droplets can be discharged normally from each of the ink nozzles when the same one page of print data is reprinted, the recording paper 3 can be printed normally with no missing dots.

Embodiment 2

Figure 8:
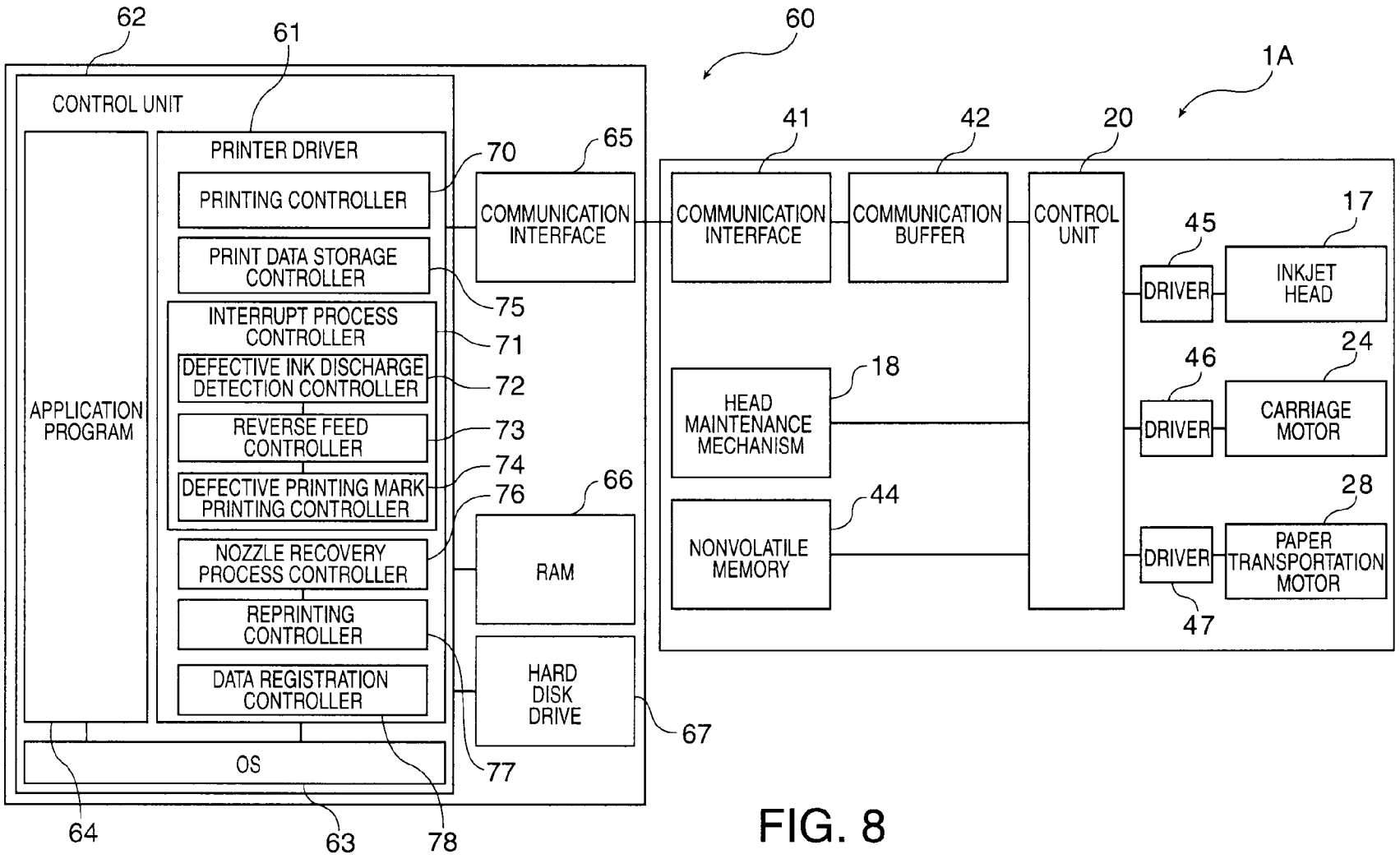
FIG. 8 is a schematic block diagram illustrating a printer driver according to a second embodiment of the invention.

A second embodiment of the invention is described next. FIG. 8 is a schematic block diagram showing the second embodiment of the invention. The description above relating to Embodiment 1 applies to this Embodiment 2 except for the differences described below. Driving the roll paper printer 1 according to the first embodiment of the invention described above is controlled by the control unit 20 inside the printer. Driving the roll paper printer 1A according to this embodiment of the invention, however, is controlled by a printer driver 61 that is installed in a host computer 60 to which the roll paper printer 1A is connected. Note that this roll paper printer 1A is constructed identically to the roll paper printer 1 described above, and like parts are identified by the same reference numerals.

As shown in FIG. 8, an operating system (OS) 63, printer driver 61, and application program 64 run on the control unit 62 of the host computer 60. A communication interface 65, RAM 66, and a hard disk drive 67 or other storage device are each connected to the control unit 62. An input/output device not shown is also connected to the host computer 60.

The printer driver 61 has a printing controller (page printing controller) 70 that controls driving the roll paper printer 1A, and an interrupt process controller 71. The interrupt process controller 71 executes an interrupt process when the roll paper printer 1A finishes printing one page of print data and immediately before a control command indicating the page break. The interrupt process controller 71 has a defective ink discharge detection controller 72, a reverse feed controller 73, and a defective printing mark printing controller 74.

The printer driver 61 has a print data storage controller 75, nozzle recovery process controller 76, reprinting controller 77, and image data registration controller 78.

The controller formed by the printer driver 61 corresponds to the printing controller 50, interrupt process controller 51, defective ink discharge detection controller 52, reverse feed controller 53, defective printing mark printing controller 54, print data storage controller 55, nozzle recovery process controller 56, reprinting controller 57, and image data registration controller 58 formed in the control unit 20 of the roll paper printer 1. Because the printer driver 61 according to this embodiment of the invention has each of these controllers, the control unit 20 of the roll paper printer 1A controls driving the inkjet head 17, head maintenance mechanism 18, carriage motor 24, and paper transportation motor 28 according to the control commands from the printer driver 61. The control unit 20 also reports the result of the defective ink discharge detection process that is executed by controlling driving the head maintenance mechanism 18 to the printer driver 61.

Print data is passed from the application program 64 through the operating system 63 to the printer driver 61. Included in the passed print data is a paper discharge command. The paper discharge command is a control command indicating a break between pages, and causes the recording paper to be conveyed a predetermined distance in transportation direction A and discharged from the paper exit 5.

When the roll paper printer 1A finishes printing the print data for one page on the print medium but just before the paper discharge command, the defective ink discharge detection controller 72 interrupts the operation printing the print data for the one page and detects whether or not the ink droplets are still discharged normally from each of the ink nozzles. More specifically, the defective ink discharge detection controller 72 controls driving the roll paper printer 1A and causes the head maintenance mechanism 18 to execute the defective ink discharge detection process. The result of the defective ink discharge detection process is then acquired through the control unit 62, and whether or not ink droplets are discharged normally from each of the ink nozzles is determined.

If the ink droplets are being discharged normally from the ink nozzles, the defective ink discharge detection controller 72 returns drive control of the roll paper printer 1A to the printing controller 70 to continue printing the print job that was interrupted. When drive control of the roll paper printer 1A is returned from the defective ink discharge detection controller 72 to the printing controller 70, the printing controller 70 sends a paper discharge command to the roll paper printer 1A and the recording paper 3 is discharged from the paper exit. If there is any print data for a next page, the printing controller 70 then proceeds to print the next print data.

If the defective ink discharge detection controller 72 determines that ink droplets are not discharged normally from an ink nozzle, control of the pending interrupt process is passed to the reverse feed controller 73, which then controls driving the roll paper printer 1A to convey the recording paper 3 a predetermined distance in the reverse direction B. More specifically, the reverse feed controller 73 sends a control command causing the paper transportation motor 28 to turn in reverse a predetermined number of steps to the roll paper printer 1A. This predetermined distance is the width of the inkjet head 17 in the transportation direction A, and in this embodiment of the invention is 1 inch, for example.

When the recording paper 3 is conveyed the predetermined distance in the reverse direction B, control of the pending interrupt process is passed to the defective printing mark printing controller 74 which controls driving the roll paper printer 1A to print the print data for the defective printing mark, which is stored in advance in nonvolatile memory 44, on the recording paper 3. The print data for the defective printing mark that is stored in the nonvolatile memory 44 is image data for a long, narrow image that can be printed on the recording paper 3 in a single pass of the inkjet head 17 in the main scanning direction. For example, the image data is for an image that is less than one inch high and is shorter than the width of the recording paper 3.

When the print data for the defective printing mark has been printed on the recording paper 3, the defective printing mark printing controller 74 returns drive control of the roll paper printer 1A to the printing controller 70, which continues the interrupted operation of printing the print data. Note that, when drive control of the roll paper printer 1A returns from the defective printing mark printing controller 74 to the printing controller 70, the printing controller 70 sends a paper discharge command to the roll paper printer 1A and the recording paper 3 is thus discharged from the paper exit 5. If there is any print data for a next page, the printing controller 70 then proceeds to print the next print data.

When the printing controller 70 controls driving the roll paper printer 1A to begin printing one page of print data, the print data storage controller 75 buffers that one page of print data to RAM 66 in the host computer 60.

If ink droplets are not discharged correctly from all of the ink nozzles and the roll paper printer 1A finishes printing the one page of print data, the nozzle recovery process controller 76 controls driving the roll paper printer 1A to execute the nozzle recovery process. More specifically, the head maintenance mechanism 18 is driven to vacuum ink from the ink nozzles. The wiper 33 is also controlled to wipe the nozzle surface 17*a* of the inkjet head 17.

When the nozzle recovery process is completed, the reprinting controller 77 controls driving the roll paper printer 1A to deliver a new printing portion of the recording paper 3 from the roll paper 2. The reprinting controller 77 also controls driving the roll paper printer 1A to print the one page of print data that was stored temporarily in RAM 66.

The image data registration controller 78 enables the user to store the desired image data in the nonvolatile memory 44 as the print data for the defective printing mark. The image data is stored in nonvolatile memory 44 by sending the control command and image data in the specified format for registering the print data for a defective printing mark to the roll paper printer 1A.

The operation of printing a defective printing mark when the printer driver 61 controls driving the roll paper printer 1A is substantially the same as the operation shown in the flow chart in FIG. 6. The operations differ in that in this embodiment the printer driver 61, instead of the control unit 20, controls driving the roll paper printer 1A to print the print data, and the print data storage controller 75 stores and holds the one page of print data in RAM 66 in the printer driver 61.

Effect of Embodiment 2

This second embodiment of the invention achieves the same effect as when applied to the roll paper printer 1 described above.

More specifically, when there may be one or more missing dots on the printed recording paper 3, a defective printing mark indicating that the printout is invalid or defective is printed on the recording paper 3. The user can therefore easily tell by looking at the printed recording paper 3 if the recording paper 3 has any missing or unprinted dots, and print quality can be assured with high precision.

Furthermore, because the print data for the defective printing mark is image data for an image C printed in a band, the user can easily know if the printed recording paper 3 is invalid or defective and should be discarded. In addition, because the image can be printed with a single pass of the inkjet head 17 in the main scanning direction, the print data for the defective printing mark can be printed in a short time.

If it is detected that ink droplets are not discharged normally from the ink nozzles of the inkjet head 17, the nozzle recovery process controller 76 in this embodiment of the invention controls driving the roll paper printer 1A to execute a nozzle recovery process to restore the ink droplet discharge state of each ink nozzle to the normal operating condition after printing the one page of print data ends. The reprinting controller 77 then controls driving the roll paper printer 1A to print the same one page of print data on new recording paper 3. As a result, the one page of print data that was formed invalid or deficient is printed again. Furthermore, because the ink droplets can be discharged normally from each of the ink nozzles when the same one page of print data is reprinted, the recording paper 3 can be printed normally with no missing dots.

In addition, this embodiment of the invention renders the function of printing a defective printing mark indicating that printing is invalid by way of the printer driver 61. This aspect of the invention can therefore control driving existing inkjet printers that have a mechanism capable of executing a defective ink discharge detection process to print indication of defective printing.

Embodiment 3

Figure 9:
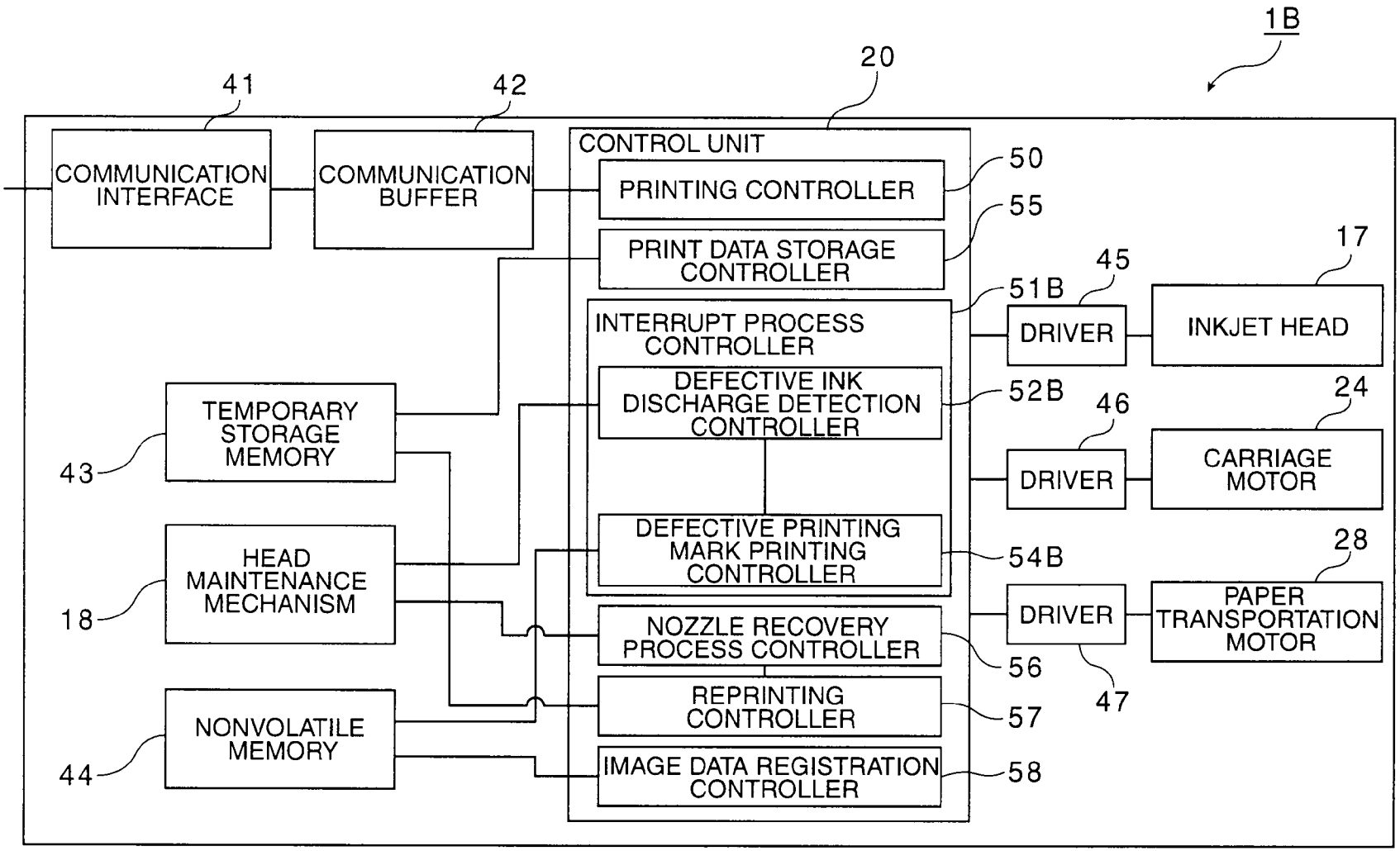
FIG. 9 is a schematic block diagram showing the control system of a roll paper printer according to a third embodiment of the invention.

A third embodiment of the invention is described next. FIG. 9 is a schematic block diagram describing this third embodiment. This embodiment differs from the first in that the reverse feed controller 53 shown in FIG. 6 is omitted. Other aspects of the roll paper printer 1B according to this embodiment of the invention and the roll paper printer 1 described above are the same, and like parts are identified by the same reference numerals below.

Control System

The control system is built around a control unit 20 including a CPU, ROM, and RAM. Print data from a host device such as a host computer is input to the control unit 20 through a communication interface 41 and communication buffer 42. Temporary storage memory 43, nonvolatile memory (nonvolatile storage) 44, and the head maintenance mechanism 18 are connected to the control unit 20, and the current change signal extracted from the conductive member 36 is input from the head maintenance mechanism 18. The inkjet head 17 is connected through a head driver 45 to the output side of the control unit 20. The carriage motor 24 and paper transportation motor 28 are also connected through motor drivers 46 and 47.

The control unit 20 has a printing controller 50 and an interrupt process controller 51B. The printing controller 50 (page printing controller) controls the inkjet head 17, carriage motor 24, and paper transportation motor 28 to print the print data. The interrupt process controller 51B executes an interrupt process when printing the print data for one page by the printing controller 50 is completed to a time just before a control command denoting the page break is executed.

The interrupt process controller 51B includes a defective ink discharge detection controller 52B and a defective printing mark printing controller 54B.

The control unit 20 also has a print data storage controller 55, nozzle recovery process controller 56, reprinting controller 57, and image data registration controller 58.

Included in the print data from the host device (host) is the print data to be printed on the recording paper, and a paper discharge command. The paper discharge command is a control command indicating a break between pages, and causes the recording paper 3 to be conveyed a predetermined distance in transportation direction A and discharged from the paper exit 5. This predetermined distance in this embodiment of the invention is the distance from where printing ends on one page and where printing starts on the next page.

Note that because this embodiment of the invention uses roll paper, a paper cut command may be inserted after the paper discharge command to sever the printed portion of the recording paper 3 from the roll. The roll paper may alternatively be discharged as a continuous, uncut length of paper. If the roll paper is label paper having a plurality of labels affixed at equal intervals on the surface of a lining, the printed paper is commonly discharged without being cut. If such label paper is used, printing is typically controlled so that each label constitutes one page.

When printing the print data for one page on the print medium is completed but just before the paper discharge command is executed, or more specifically when printing all print data in the one-page range is completed, the defective ink discharge detection controller 52B interrupts the operation printing the print data for the one page by the printing controller 50 and detects whether or not the ink droplets are still discharged normally from each of the ink nozzles. More specifically, the defective ink discharge detection controller 52B controls driving the carriage motor 24 to move the inkjet head 17 to the standby position, and then controls driving the inkjet head 17 and head maintenance mechanism 18 to detect whether or not ink droplets are discharged normally from each of the ink nozzles based on the current change signal extracted from the conductive member 36.

If the ink droplets are being discharged normally from the ink nozzles, the defective ink discharge detection controller 52B returns drive control of the roll paper printer 1 to the printing controller 50 to continue executing the print job that was interrupted. When drive control of the roll paper printer 1 is returned from the defective ink discharge detection controller 52B to the printing controller 50, the printing controller 50 executes the paper discharge command and the recording paper 3 is discharged from the paper exit 5. If there is any print data for a next page, the printing controller 50 then proceeds to print the next print data.

When the defective ink discharge detection controller 52B detects that ink droplets are not discharged normally from an ink nozzle, control of the pending interrupt process is passed to the defective printing mark printing controller 54B that prints the print data for the defective printing mark, which is stored in advance in nonvolatile memory 44, on the recording paper 3. The print data for indicating defective printing is printed without advancing or reversing the paper so that the defective printing mark is printed on top of the line that was just printed. The print data for the defective printing mark that is stored in the nonvolatile memory 44 is image data for a long, narrow image that can be printed on the recording paper 3 in a single pass of the inkjet head 17 in the main scanning direction. For example, because the inkjet head can print a band one inch high, for example, in this embodiment of the invention, the image data is for an image that is less than one inch high and is shorter than the width of the recording paper 3.

When the print data for the defective printing mark is printed on the recording paper 3, the defective printing mark printing controller 54B returns drive control of the roll paper printer 1 to the printing controller 50, which continues the interrupted operation of printing the print data. More specifically, when drive control of the roll paper printer 1 returns from the defective printing mark printing controller 54B to the printing controller 50, the printing controller 50 executes the paper discharge command and the recording paper 3 is thus discharged from the paper exit 5. If there is any print data for a next page, the printing controller 50 then proceeds to print the next print data.

When the printing controller 50 begins printing one page of print data, the print data storage controller 55 buffers that one page of print data to the temporary storage memory 43.

If ink droplets are not discharged correctly from an ink nozzle and the printing controller 50 finishes printing the one page of print data, or printing is more specifically completed to the paper discharge command, the nozzle recovery process controller 56 executes the nozzle recovery process to restore the ink droplet discharge state of each ink nozzle to normal operating condition. More specifically, when recording paper 3 on which the defective printing mark was printed is discharged from the paper exit 5, the nozzle recovery process controller 56 controls driving the head maintenance mechanism 18 to vacuum ink from the ink nozzles. The carriage motor 24 and head maintenance mechanism 18 are also controlled to wipe the nozzle surface 17*a* of the inkjet head 17 with the wiper 33.

When the nozzle recovery process is completed, the reprinting controller 57 delivers a new printing portion of the recording paper 3 from the roll paper 2 and prints the one page of print data that was buffered in the temporary storage memory 43.

The image data registration controller 58 enables the user to store the desired image data in the nonvolatile memory 44 as the print data for the defective printing mark. When a corresponding control command and image data in the specified format for registering the print data for a defective printing mark is received from the host, the image data is stored in nonvolatile memory 44.

Printing the Defective Printing Mark

The process of printing indication of defective printing is the process shown in FIG. 6 but omitting step ST8.

More specifically, if it is determined in step ST4 that ink droplets are not discharged normally from all ink nozzles (step ST4 returns No), the defective printing mark printing controller 54B interrupts the operation of the printing controller 50 printing the one page of print data, and prints the image data stored in the nonvolatile memory 44 as the print data for printing a defective printing mark (step ST9) without advancing or reversing the recording paper. Other aspects of this process are controlled as described by the flow chart in FIG. 6.

Effect of Embodiment 3

When printing one page of print data to the recording paper 3 is completed to a time just before the paper discharge command, which is a control command indicating a page break, the process of printing one page of print data by the printing controller 50 is interrupted and the defective ink discharge detection controller 52B determines whether or not ink droplets are discharged normally from the ink nozzles of the inkjet head 17. If the ink droplets are not discharged normally, an interrupt process executes so that the defective printing mark printing controller 54B prints a defective printing mark on the recording paper 3.

More specifically, when there may be one or more missing dots on the recording paper 3 to which the print data was printed, a defective printing mark indicating that the printout is invalid or defective is printed on the recording paper 3. The user can therefore easily tell by looking at the printed recording paper 3 if the recording paper 3 has any missing or unprinted dots, and print quality can be assured with high precision.

Throughput is also improved in this embodiment of the invention compared with the first embodiment because the recording paper is not reversed.

Furthermore, because the print data for the defective printing mark is image data for an image C printed in a band, the user can easily know if the printed recording paper 3 is invalid or defective and should be discarded. In addition, because the image can be printed with a single pass of the inkjet head 17 in the main scanning direction, the print data for the defective printing mark can be printed in a short time.

If it is detected that ink droplets are not discharged normally from the ink nozzles of the inkjet head 17, the nozzle recovery process controller 56 in this embodiment of the invention executes a nozzle recovery process to restore the ink droplet discharge state of each ink nozzle to the normal operating condition after printing the one page of print data ends, and the reprinting controller 57 then prints the same one page of print data on new recording paper 3. As a result, the one page of print data that was formed invalid or deficient is printed again. Furthermore, because the ink droplets can be discharged normally from each of the ink nozzles when the same one page of print data is reprinted, the recording paper 3 can be printed normally with no missing dots.

Another aspect of the invention combines the printing methods of the third and first embodiments. More specifically, whether to reverse the recording paper and print the defective printing mark, or whether to print the defective printing mark over the line that was just printed, can be selected automatically according to the position of the printed recording paper just before defective ink discharge detection. This enables printing the defective printing mark at a position where it can be readily recognized by the user.

Other Aspects of the Invention

Embodiments of the invention applied to a roll paper printer 1 or 1A can use the communication buffer 42 as the temporary storage memory 43 for buffering one page of print data. In this case the print data for the one page being printed is stored in the communication buffer 42 until step ST6 or step ST13 is completed.

When the invention is implemented in a printer driver 61, the image data is stored and held in nonvolatile memory 44 in the roll paper printer 1, but this image data may alternatively be stored on the hard disk drive 67 of the host computer 60. In this case the data registration controller 78 stores image data of the predetermined format on the hard disk drive 67 of the host computer 60.

Furthermore, while the print data for printing the indication of defective printing is image data for printing an image C in a stripe in the embodiments described above, the print data may be character data for printing a text message.

The predetermined distance that the recording paper 3 is conveyed in the reverse direction B by the reverse feed controller 53 in the first embodiment described above is not limited to the width of the inkjet head 17. For example, if this predetermined distance is increased, the defective printing mark can be printed in the middle of the recording paper 3 in the transportation direction A.

The control command denoting a page break is also not limited to a paper discharge command. For example, this control command may be a paper cut command for cutting the recording paper 3 after advancing it a predetermined distance.

The point at which the print data storage controller 55 stores and holds the one page of print data can be any time before the printing controller 50 prints the one page of print data. Likewise, the point at which the print data storage controller 75 stores and holds the one page of print data can be any time before the printing controller 70 controls driving the roll paper printer 1A to start printing the one page of print data.

When it is detected in the foregoing embodiments that ink droplets are not being discharged normally from an ink nozzle of the inkjet head 17, the nozzle recovery process (step ST12) and the reprinting process (step ST13) are executed after the recording paper 3 on which the striped image C is printed is discharged in step ST11. However, the roll paper printer 1 may be driven and controlled to go from step ST11 to step ST7 without executing either or both the nozzle recovery process and reprinting process.

Even if the nozzle recovery process or reprinting process is not executed, the defective printing mark indicating that the printout is not valid is printed on the recording paper 3 when there is the chance of the printed recording paper 3 containing unprinted or missing dots. The user can therefore separate recording paper 3 that might contain unprinted dots from recording paper 3 that is printed normally and does not have any unprinted dots after printing all print data from the host device is completed. The single pages of print data that might contain unprinted missing dots can thus also be identified and reprinted.

In another aspect of the invention, when it is detected in the foregoing embodiments that ink droplets are not being discharged normally from an ink nozzle of the inkjet head 17, the user can be prompted to select whether to execute the nozzle recovery process (step ST12) and the reprinting process (step ST13) after the recording paper 3 on which the striped image C is printed is discharged in step ST11.

In this case the roll paper printer 1 is controlled to go from step ST11 to step ST12 or step ST13 only when these steps are selected to be executed. When executing these steps is not selected, the roll paper printer 1 is controlled and driven to go from step ST11 to step ST7.

This aspect of the invention enables executing the nozzle recovery process and reprinting process (steps ST12 and ST13) only when printing pages for which high print quality is required.

When the reprinting controller 57 reprints the one page of print data in step ST13 in the foregoing embodiments, the operation from step ST3 to ST6, or the operation of steps ST3, ST4 and ST8 to ST13, repeats. However, the number of times the operation from step ST3 to ST6, or the operation of steps ST3, ST4 and ST8 to ST13, repeats can be limited in step ST13. If the number of times the steps repeat is thus limited and the repetition count reaches the maximum limit, the roll paper printer 1 may be controlled to output an error and stop operation.

The foregoing embodiments execute an interrupt process by way of an interrupt process controller when printing one page of print data (print data for one page unit) is completed to a time just before a paper discharge command or other control command indicating a page break is executed. The interrupt process controller 51 may, however, execute the interrupt process (such as a defective ink discharge detection process) after printing a predetermined number of lines of the print data for one page. This aspect of the invention enables evaluating the printing condition at shorter intervals in units smaller than one page, and can thus avoid continuing printing after an ink discharge problem occurs, and can thus reduce wasteful consumption of ink.

If a discharge defect is detected before all of the print data has been printed in this aspect of the invention, the defective printing mark may be printed over the preceding print line on the recording paper without reversing the paper and the paper then discharged as described in the third embodiment. This improves throughput because the defective printing mark is printed without reversing the paper.

Furthermore, if the position where the defective printing mark is printed in this aspect of the invention is the position after the recording paper is advanced in transportation direction A to a predetermined position, or the defective printing mark is printed at a predetermined position such as the last line at the downstream end of the printing area, the user can more easily recognize the defective printing mark while maintaining better throughput than when the paper is reversed.

The foregoing embodiments execute an interrupt process by way of an interrupt process controller when printing one page of print data (print data for one page unit) is completed to a time just before a paper discharge command or other control command indicating a page break is executed. However, when printing to continuous recording paper, such as in a roll paper printer, the interrupt process (such as a defective ink discharge detection process) of the interrupt process controller 51 may be executed after executing the paper discharge command or other control command denoting a page break.

In this aspect of the invention, defective ink discharge detection and printing a defective printing mark occur after finishing printing one page and discharging the printed recording paper. Because the area for printing the defective printing mark is conveyed in reverse to the printing area of the inkjet head after first discharging the one page portion of recording paper, the recording paper can be easily positioned regardless of the size (printing area) of the print data printed on the recording paper, and the printing position of the defective printing mark on the paper can be easily controlled to the desired position (such as the last line at the downstream end of the printing area).

An indication of defective printing is printed on the recording paper in the embodiments described above, but defective printing may be reported using an alarm device such as a buzzer on the printer or on the host device.

More specifically, when printing the print data for one page (a one page unit) is completed to just before the paper discharge command or other control command denoting a page break, the interrupt process controller executes an interrupt process and detects ink discharge defects. If the result of this defective ink discharge detection process finds that ink is not discharge normally from an ink nozzle, the buzzer is sounded to report the printing problem. The user thus knows from hearing the buzzer that printing is deficient due to an ink discharge defect.

When defective ink discharge is reported by sounding a buzzer, the user can press a button on the printer or input a command from an input device of the host device to stop the buzzer and cancel the report. When the report is cancelled, the paper discharge command that was interrupted by the interrupt process is executed and the recording paper 3 is discharged from the paper exit 5. The user can thus appropriately discharge the recording paper knowingly after the buzzer sounds.

Whether a defective printing mark is printed on the paper or a buzzer is sounded when printing is invalid can be controlled by configuring the printer using a DIP switch or asserting a command from the host device, for example. The buzzer may also be sounded in addition to printing the defective printing mark on the recording paper. Because the defective printing mark is printed on the paper in this case, the buzzer may be sounded for a predetermined length of time, such as several seconds after printing the defective printing mark ends. This aspect of the invention makes it even easier for the user to know that a printing problem has occurred. Of course, stopping the buzzer may also be controlled to occur automatically after a lapse of a certain time.

Data stored in nonvolatile memory in the printer is used as the data for printing indication of a printing problem in the first to third embodiments of the invention described above. Alternatively, the first to third embodiments may be modified so that the printer sends an appropriate report to the host computer or other host device when the result of the defective ink discharge detection process indicates an ink discharge problem, and the host computer then sends print data for the defective printing mark to the printer based on the received report. The timing for the printer to send this report to the host computer may be, for example, when a printing problem is detected by the defective ink discharge detection process, or when the printer finishes conveying the recording paper to the printing position.

Note the invention can also be applied to inkjet printers that print on sheet media instead of roll paper, and the invention is not limited to roll paper printers.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A method of printing an indication of defective printing, comprising:

printing one page of print data on a print medium using an inkjet head that moves in a main scanning direction perpendicular to a transportation direction by driving a carriage motor and a paper transportation motor to convey the print medium in the transportation direction;

executing an interrupt process after completing printing one page of print data but before executing a control command indicating a page break, the interrupt process including:

interrupting an operation of printing the print data that drives the carriage motor and the paper transportation motor, moving the inkjet head to a standby position by driving the carriage motor, detecting whether or not ink droplets are being discharged normally from each ink nozzle of the inkjet head, and when it is detected that ink droplets are not being discharged normally from an ink nozzle in the standby position, then conveying the print medium a predetermined distance in a reverse direction that is opposite to the transportation direction in which the print medium is conveyed when printing the one page of print data by driving the paper transportation motor, and printing previously stored print data representing a defective printing mark on the print medium; wherein detecting whether or not ink droplets are being discharged normally from each ink nozzle of the inkjet head comprises detecting a current change produced by charged ink landing on an absorbent member; and wherein the print data representing a defective printing mark is data for an image that can be printed in a band on the print medium in a single pass while the inkjet head moves in the main scanning direction;

when it is detected that ink droplets are being discharged normally from an ink nozzle in the standby position, then executing a control command indicating a page break that conveys the print medium in the transportation direction and that discharges the print medium; and printing a next page of print data on the print medium if the print data for the next page is received.

2. The method of printing an indication of defective printing described in claim 1, further comprising:

storing and holding the one page of print data;

executing a nozzle recovery process to restore an ink droplet discharge state of each ink nozzle to a normal operating condition after it is detected that the ink droplets are not discharged normally from an ink nozzle; and reprinting the one page of print data on new print medium.

3. An inkjet printer comprising:

a page printing controller that prints one page of print data on a print medium using an inkjet head that moves in a main scanning direction perpendicular to a transportation direction by driving a carriage motor and a paper transportation motor to convey the print medium in the transportation direction;

an interrupt process controller that executes an interrupt process that interrupts an operation of printing the print data that drives the carriage motor and the paper transportation motor after the page printing controller completes printing one page of print data but before executing a control command indicating a page break, and that moves the inkjet head to a standby position by driving the carriage motor; and a storage that holds print data representing a defective printing mark;

the interrupt process controller including:

a defective ink discharge detection controller that detects, while the inkjet head is in the standby position, whether or not ink droplets are being discharged normally from each ink nozzle of an inkjet head by detecting a current change produced by charged ink landing on an absorbent member, a reverse transportation controller that conveys the print medium a predetermined distance in a reverse direction, which is opposite to the transportation direction in which the print medium is conveyed when printing the one page of print data, when the defective ink discharge detection controller detects that ink droplets are not being discharged normally from each of the ink nozzles, and a defective printing mark printing controller that prints the print data representing a defective printing mark on the print medium when the print medium is conveyed in the reverse direction; and wherein the print data representing a defective printing mark is data for an image that can be printed in a band on the print medium in a single pass while the inkjet head moves in the main scanning direction.

4. The inkjet printer described in claim 3, further comprising:

an image data registration controller that stores and holds the print data representing the defective printing mark in the storage.

5. The inkjet printer described in claim 3, further comprising:

a print data storage that stores and holds the one page of print data;

a nozzle recovery process controller that executes a nozzle recovery process to restore the ink droplet discharge state of each ink nozzle to a normal operating condition after the page printing controller completes printing the one page of print data when ink droplets are not discharged normally from each ink nozzle; and a reprinting controller that prints the one page of print data stored by the print data storage to a new print medium when the nozzle recovery process is executed.

6. A method of printing an indication of defective printing, comprising:

a printing step of printing print data on a print medium using ink droplets discharged from ink nozzles of an inkjet head that moves in a main scanning direction perpendicular to a transportation direction by driving a carriage motor and a paper transportation motor to convey the print medium in the transportation direction;

an interrupting step of interrupting an operation of printing the print data that drives the carriage motor and the paper transportation motor, a moving step of moving the inkjet head to a standby position by driving the carriage motor;

a defective ink discharge detection step of detecting, while the inkjet head is in the standby position, if ink droplets are being discharged normally from each ink nozzle of the inkjet head after the printing step; and when it is detected that ink droplets are not being discharged normally from an ink nozzle, then a defective printing mark printing step of conveying the print medium to a position that is printable by the inkjet head using the paper transportation motor, and printing print data representing a defective printing mark on the print medium; wherein detecting whether or not ink droplets are being discharged normally from each ink nozzle of the inkjet head comprises detecting a current change produced by charged ink landing on an absorbent member; and wherein the print data representing a defective printing mark is data for an image that can be printed in a band on the print medium in a single pass while the inkjet head moves in the main scanning direction.

7. The method of printing an indication of defective printing described in claim 6, wherein:

when the print data is a page unit of print data, the print medium is conveyed the page unit by the transportation motor after printing the page unit of print data is completed, and the defective ink discharge detection step executes after the print medium is conveyed.

8. The method of printing an indication of defective printing described in claim 6, wherein:

the print medium is conveyed to a position that is printable by the inkjet head by the transportation motor after printing a predetermined range of the print data is completed, and the defective ink discharge detection step executes after the print medium is conveyed.

9. The method of printing an indication of defective printing described in claim 6, wherein:

after the defective printing mark printing step, the print medium on which the defective printing mark is printed is discharged and the print data is reprinted on another part or another piece of the print medium.

10. The method of printing an indication of defective printing described in claim 6, wherein:

the print medium is conveyed a distance equal to the printable width of the inkjet head in the transportation direction in the defective printing mark printing step.

11. An inkjet printer comprising:

an inkjet head having ink nozzles that discharge ink droplets;

an inkjet head driving mechanism that moves the inkjet head in a main scanning direction perpendicular a the transportation direction a head maintenance mechanism that detects a discharge state of the ink droplets while the inkjet head is in a standby position;

a transportation mechanism that conveys a print medium that is printed upon using the ink droplets in the transportation direction or in a reverse direction, which is opposite to the transportation direction;

a storage for storing print data for printing a defective printing mark; and a control unit that controls the inkjet head, the head maintenance mechanism, and the transportation mechanism, the control unit including:

a printing controller that controls the inkjet head to print the print data on the print medium; and an interrupt process controller that executes an interrupt process that interrupts an operation of printing the print data that drives the inkjet head and the transportation mechanism when the printing controller completes printing a predetermined range of the print data; the interrupt process controller including:

a defective ink discharge detection controller that controls the inkjet head and head maintenance mechanism, and detects, while the inkjet head is in the standby position, if ink droplets are being discharged normally from an ink nozzle by detecting a current change produced by charged ink landing on an absorbent member;

a transportation controller that controls the transportation mechanism to convey the print medium to a position that is printable by the inkjet head when ink droplets are not discharged normally from an ink nozzle; and a defective printing mark printing controller that controls the inkjet head to print the print data for a defective printing mark on the print medium; and wherein the print data representing a defective printing mark is data for an image that can be printed in a band on the print medium in a single pass while the inkjet head moves in a main scanning direction perpendicular to the transportation direction.

12. An inkjet printer comprising:

an inkjet head having ink nozzles that discharge ink droplets;

an inkjet head driving mechanism that moves the inkjet head in a main scanning direction perpendicular a the transportation direction;

a head maintenance mechanism that detects, while the inkjet head is in a standby position, a discharge state of the ink droplets;

a transportation mechanism that conveys a print medium that is printed upon using the ink droplets in the transportation direction;

a storage for storing print data for printing a defective printing mark; and a control unit that controls the inkjet head, the head maintenance mechanism, and the transportation mechanism, the control unit including:

a printing controller that controls the inkjet head to print the print data on the print medium; and an interrupt process controller that executes an interrupt process that interrupts an operation of printing the print data that drives the inkjet head and the transportation mechanism when the printing controller completes printing a predetermined range of the print data; the interrupt process controller including:

a defective ink discharge detection controller that controls the inkjet head and head maintenance mechanism, and detects, while the inkjet head is in a standby position, if ink droplets are being discharged normally from an ink nozzle by detecting a current change produced by charged ink landing on an absorbent member; and a defective printing mark printing controller that controls the inkjet head to print the print data for a defective printing mark at a bottom end of the predetermined range printed by the printing controller on the print medium when ink droplets are not discharged normally from an ink nozzle; and wherein the print data representing a defective printing mark is data for an image that can be printed in a band on the print medium in a single pass while the inkjet head moves in the main scanning direction.

13. A defective printing notification method comprising:

a printing step of printing print data on a print medium by ink droplets discharged from ink nozzles of an inkjet head that moves in a main scanning direction perpendicular to a transportation direction by driving a carriage motor and a paper transportation motor to convey the print medium in the transportation direction;

an interrupting step of interrupting an operation of printing the print data that drives the carriage motor and the paper transportation motor, a moving step of moving the inkjet head to a standby position by driving the carriage motor;

a defective ink discharge detection step of detecting, while the inkjet head is in the standby position, whether or not ink droplets are discharged normally from each ink nozzle of the inkjet head after the printing step;

a defective printing mark printing step of conveying the print medium to a position that is printable by the inkjet head using the paper transportation motor, and printing print data representing a defective printing mark on the print medium when the defective ink discharge detection step detects that ink droplets are not being discharged normally from an ink nozzle;

a reporting step of reporting by a notification device when the defective ink discharge detection step detects that ink droplets are not being discharged normally from an ink nozzle;

a selecting step of selecting the defective printing mark printing step and/or the reporting step; wherein detecting whether or not ink droplets are being discharged normally from each ink nozzle of the inkjet head comprises detecting a current change produced by charged ink landing on an absorbent member.

14. An ink jet printer comprising:

an inkjet head having ink nozzles for discharging ink droplets;

an inkjet head driving mechanism that moves the inkjet head in a main scanning direction perpendicular to the transportation direction;

a head maintenance mechanism that detects a discharge state of the ink droplets while the inkjet head is in a standby position;

a transportation mechanism that conveys a print medium in the transportation direction;

a notification device that reports a discharge state of the ink droplets;

a control unit that controls the inkjet head, the head maintenance mechanism, the transportation mechanism, and the notification device, the control unit including:

a printing controller that controls the inkjet head to print the print data on a print medium; and an interrupt process controller that executes an interrupt process that interrupts an operation of printing the print data that drives the inkjet head and the transportation mechanism when the printing controller completes printing a predetermined range of the print data; the interrupt process controller including:

a defective ink discharge detection controller that controls the inkjet head and the head maintenance mechanism, and detects, while the inkjet head is in the standby position, if ink droplets are being discharged normally from the ink nozzles by detecting a current change produced by charged ink landing on an absorbent member;

a defective printing mark printing controller that controls the inkjet head to print the print data for a defective printing mark on the print medium when ink droplets are not discharged normally from an ink nozzle;

a notification controller that controls the notification device to report the discharge state of the ink droplets when the ink droplets are not discharged normally from the ink nozzle; and a selector that selects whether the defective printing mark printing controller and/or the notification controller is executed.

* * * * *